US006458006B1

(12) United States Patent
Westbrook

(10) Patent No.: US 6,458,006 B1
(45) Date of Patent: Oct. 1, 2002

(54) SODA POP RING FOR KIDS

(76) Inventor: Anthony Westbrook, 3909 Flat Shoals Pkwy., Decatur, GA (US) 30034

( * ) Notice: Subject to any disclaimer, the term of this patent is extended or adjusted under 35 U.S.C. 154(b) by 0 days.

(21) Appl. No.: 09/627,701

(22) Filed: Jul. 28, 2000

(51) Int. Cl.[7] ..... A63H 1/00
(52) U.S. Cl. ..... 446/77; 81/3.09; 81/3.15
(58) Field of Search ..... 206/457, 458; 81/3.09, 3.15; 63/1.11, 1.12, 1.14; 446/77

(56) References Cited

U.S. PATENT DOCUMENTS

| | | | | | |
|---|---|---|---|---|---|
| 888,580 | A | * | 5/1908 | Brinn | 81/3.15 |
| 3,341,242 | A | * | 9/1967 | Carson | 81/3.15 |
| 4,825,728 | A | | 5/1989 | Mitchell | |
| 4,869,134 | A | | 9/1989 | Sprecher | |
| 5,029,495 | A | | 7/1991 | Rosenberger | |
| 5,257,566 | A | * | 11/1993 | Schultz | 81/3.09 |
| 5,329,832 | A | | 7/1994 | Tegethoff | |
| D364,431 | S | | 11/1995 | Diecidue et al. | |
| 5,503,274 | A | | 4/1996 | Toffler et al. | |
| 5,916,337 | A | * | 6/1999 | Caniglia et al. | 81/3.15 |
| 6,105,200 | A | * | 8/2000 | Cooper | 81/3.09 |

* cited by examiner

*Primary Examiner*—Sam Rimell

(57) ABSTRACT

A soda pop ring for kids for providing children with a novelty item. The soda pop ring for kids includes a ring member having ends and being formed in a circular loop with the ends being spaced apart and being in close proximity to one another, and also having a top and a bottom and a central portion and end portions with the central portion having a greater width than the end portions and with selected inscriptions protruding outwardly from the top of the ring member which is removeably secured to the top of a cap of a soda pop bottle.

1 Claim, 3 Drawing Sheets

SODA POP RING FOR KIDS

BACKGROUND OF THE INVENTION

1. Field of the Invention

The present invention relates to toy ring attached to a cap of a soda pop bottle and more particularly pertains to a new soda pop ring for kids for providing children with a novelty item.

2. Description of the Prior Art

The use of toy ring attached to a cap of a soda pop bottle is known in the prior art. More specifically, toy ring attached to a cap of a soda pop bottle heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 364,431 U.S. Pat. Nos. 5,503,274; 5,029,495; 4,869,134; 5,329,832; and U.S. Pat. No. 4,825,728.

While these devices fulfill their respective, particular objectives and requirements, the aforementioned patents do not disclose a new soda pop ring for kids. The inventive device includes a ring member having ends and being formed in a circular loop with the ends being spaced apart and being in close proximity to one another, and also having a top and a bottom and a central portion and end portions with the central portion having a greater width than the end portions and with selected inscriptions protruding outwardly from the top of the ring member which is removeably secured to the top of a cap of a soda pop bottle.

In these respects, the soda pop ring for kids according to the present invention substantially departs from the conventional concepts and designs of the prior art, and in so doing provides an apparatus primarily developed for the purpose of providing children with a novelty item.

SUMMARY OF THE INVENTION

In view of the foregoing disadvantages inherent in the known types of toy ring attached to a cap of a soda pop bottle now present in the prior art, the present invention provides a new soda pop ring for kids construction wherein the same can be utilized for providing children with a novelty item.

The general purpose of the present invention, which will be described subsequently in greater detail, is to provide a new soda pop ring for kids apparatus and method which has many of the advantages of the toy ring attached to a cap of a soda pop bottle mentioned heretofore and many novel features that result in a new soda pop ring for kids which is not anticipated, rendered obvious, suggested, or even implied by any of the prior art toy ring attached to a cap of a soda pop bottle, either alone or in any combination thereof.

To attain this, the present invention generally comprises a ring member having ends and being formed in a circular loop with the ends being spaced apart and being in close proximity to one another, and also having a top and a bottom and a central portion and end portions with the central portion having a greater width than the end portions and with selected inscriptions protruding outwardly from the top of the ring member which is removeably secured to the top of a cap of a soda pop bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new soda pop ring for kids apparatus and method which has many of the advantages of the toy ring attached to a cap of a soda pop bottle mentioned heretofore and many novel features that result in a new soda pop ring for kids which is not anticipated, rendered obvious, suggested, or even implied by any of the prior art toy ring attached to a cap of a soda pop bottle, either alone or in any combination thereof.

It is another object of the present invention to provide a new soda pop ring for kids which may be easily and efficiently manufactured and marketed.

It is a further object of the present invention to provide a new soda pop ring for kids which is of a durable and reliable construction.

An even further object of the present invention is to provide a new soda pop ring for kids which is susceptible of a low cost of manufacture with regard to both materials and labor, and which accordingly is then susceptible of low prices of sale to the consuming public, thereby making such soda pop ring for kids economically available to the buying public.

Still yet another object of the present invention is to provide a new soda pop ring for kids which provides in the apparatuses and methods of the prior art some of the advantages thereof, while simultaneously overcoming some of the disadvantages normally associated therewith.

Still another object of the present invention is to provide a new soda pop ring for kids for providing children with a novelty item.

Yet another object of the present invention is to provide a new soda pop ring for kids which includes a ring member having ends and being formed in a circular loop with the ends being spaced apart and being in close proximity to one another, and also having a top and a bottom and a central portion and end portions with the central portion having a greater width than the end portions and with selected inscriptions protruding outwardly from the top of the ring member which is removeably secured to the top of a cap of a soda pop bottle.

Still yet another object of the present invention is to provide a new soda pop ring for kids that provides the kids with another method of receiving a toy with which they can play.

Even still another object of the present invention is to provide a new soda pop ring for kids that gives the soft drink manufacturers a method of increasing their sales of soft drinks to kids by including a toy with the soft drink.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
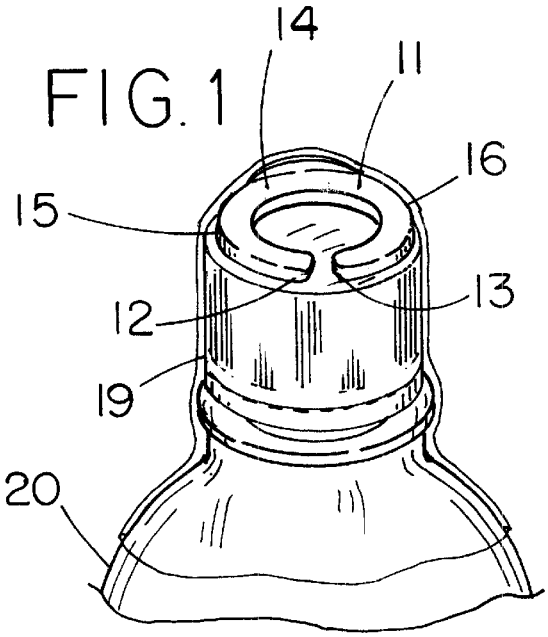
FIG. 1 is a perspective view of a new soda pop ring for kids according to the present invention.
Figure 2:
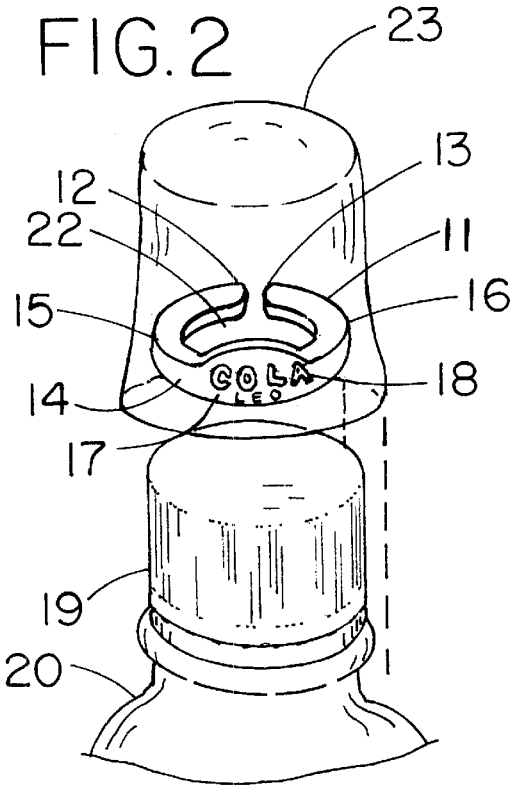
FIG. 2 is another perspective view of the present invention.
Figure 4:
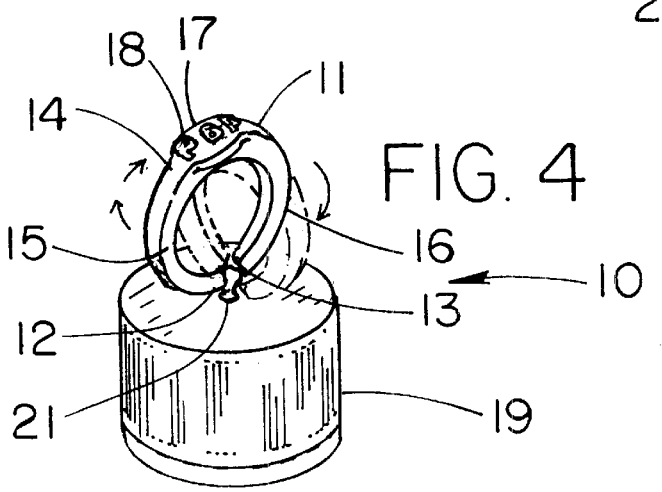
FIG. 4 is yet another perspective view of the present invention.
Figure 5:
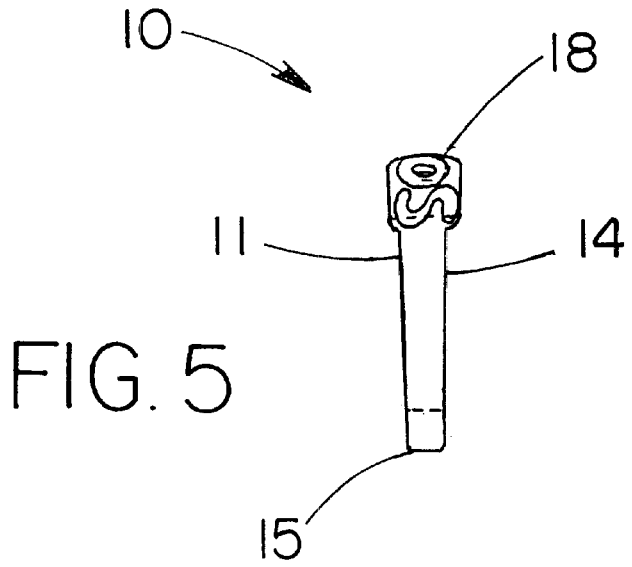
FIG. 5 is an end elevational view of the present invention.
Figure 3:
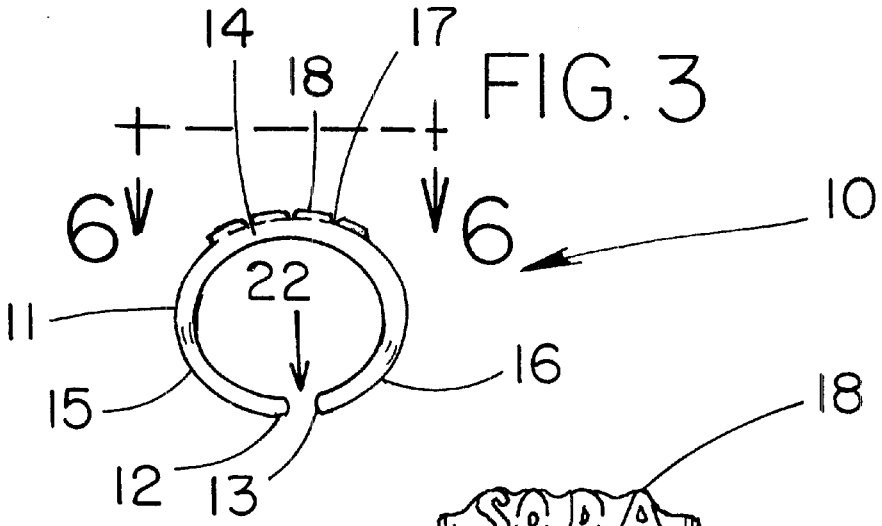
FIG. 3 is a side elevational view of the present invention.
Figure 6:
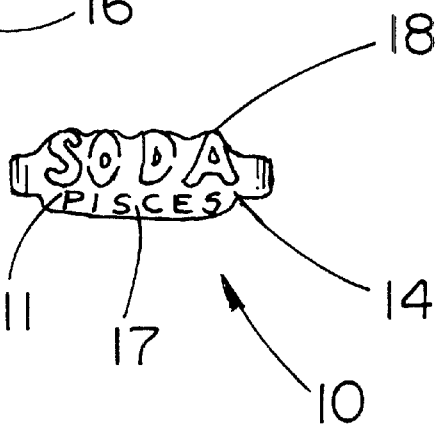
FIG. 6 is a top plan view of the present invention.
Figure 7:
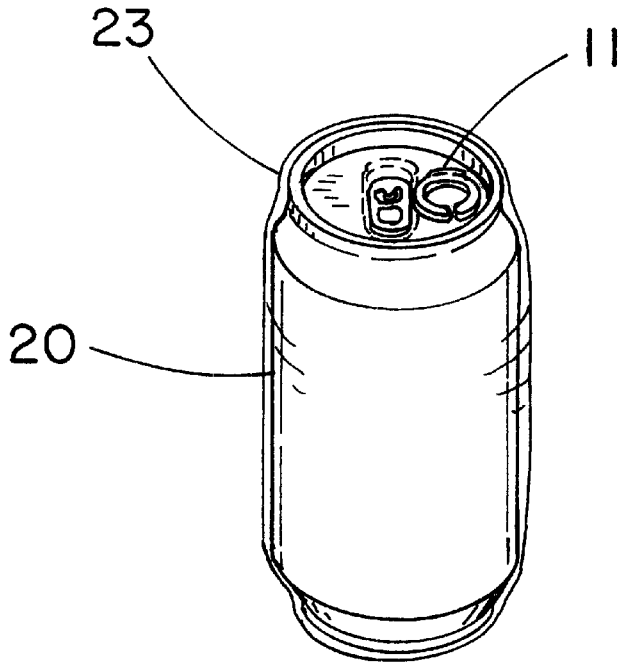
FIG. 7 is perspective view of the present invention on a soda can.

With reference now to the drawings, and in particular to FIGS. 1 through 7 thereof, a new soda pop ring for kids embodying the principles and concepts of the present invention and generally designated by the reference numeral 10 will be described.

As best illustrated in FIGS. 1 through 7, the soda pop ring for kids 10 generally comprises a ring member 11 having ends 12,13 and being formed in a circular loop with the ends 12,13 being spaced apart and being in close proximity to one another. The ring member 11 has a top 17 and a bottom 22 and is adapted to be removeably and conventionally secured to a cap 19 of a soda pop bottle 20. The bottom 22 includes the ends 12,13 of the ring member 11, and the ring member 11 includes a central portion 14 and end portions 15,16. The top 17 of the ring member 11 includes the central portion 14 and raised inscriptions 18 protruding outwardly therefrom. The ring member 11 has a diameter of approximately ¾ inch and has a width ranging from 1/16 inch to ⅛ inch.

As a first embodiment of the soda pop ring 10, the ring member 11 is adapted to securely and conventionally attach on its side upon a top of the cap 19 of a soda pop bottle 20.

As a second embodiment of the soda pop ring 10, the ends 12,13 of the ring member 11 are adapted to be securely and conventionally attached to a support member 21 protruding from a top of the cap 19 of a soda pop bottle 20.

As a third embodiment of the soda pop ring 10, the ring member 11 is securely retained upon the cap 19 and upon a top of the soda pop can 20 with a cover member 23

In use, the user which would be a child would remove the ring member from the top of the cap of the soda pop bottle and would be able to place the ring member on the desired finger with the ring member having a particular inscription protruding from a top of the ring member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soda pop ring for kids comprising:

a container having a top opening, said container being adapted for containing a beverage;

a cap for selectively attaching to said container over said top opening for selectively closing said top opening, said cap having a top wall and a perimeter wall extending from said top wall to form an interior for receiving a top portion of said container;

a ring member having ends and being formed in a circular loop with said ends being spaced apart and being in close proximity to one another, said ring member having a top and a bottom and being removably secured to the top wall of said cap, said bottom including said ends of said ring member, said ring member including a central portion and end portions, said central portion having a greater width than said end portions, said top of said ring member including said central portion, said top of said ring member including raised inscriptions protruding outwardly therefrom, said ring member having a diameter of approximately ¾ inch and having a width ranging from 1/16 inch to ⅛ inch; and a cover member removably mounted on said cap in a manner covering said ring member and the top wall of said cap and at least a portion of said perimeter wall of said cap for protecting said ring member prior to removal from said cap, said cover member having a top portion positionable adjacent to said ring member and said perimeter wall of said cap, said cover member having a peripheral portion positionable adjacent to said perimeter wall.

* * * * *